US009816280B1

(12) United States Patent
Reitnauer

(10) Patent No.: US 9,816,280 B1
(45) Date of Patent: Nov. 14, 2017

(54) PORTABLE FLOOR

(71) Applicant: Matthew Reitnauer, Emmaus, PA (US)

(72) Inventor: Matthew Reitnauer, Emmaus, PA (US)

( * ) Notice: Subject to any disclaimer, the term of this patent is extended or adjusted under 35 U.S.C. 154(b) by 0 days.

(21) Appl. No.: 15/341,728

(22) Filed: Nov. 2, 2016

(51) Int. Cl.
*E04G 9/08* (2006.01)
*E04G 11/36* (2006.01)

(52) U.S. Cl.
CPC ..... *E04G 11/36* (2013.01); *E04G 9/083* (2013.01)

(58) Field of Classification Search
CPC . E04G 9/08; E04G 9/083; E04G 11/36; E04F 15/00; E04F 15/02; E04F 15/02183; E04F 15/02033; E04F 15/02038; E04F 15/163; E04F 15/166; E04F 15/16; E04F 2201/0594; B62D 55/00; B62D 55/02; B62D 55/04; B62D 55/06; B62D 55/062; B62D 55/0655; B62D 55/08; B62D 55/18; B62D 55/20; B62D 55/202; B62D 55/205; B62D 55/21; B62D 55/213
USPC ..... 404/35, 39, 41
See application file for complete search history.

(56) References Cited

U.S. PATENT DOCUMENTS 3,295,269 A * 1/1967 Schuster ..... A45B 9/00 182/41
3,611,655 A 10/1971 Loebner
4,315,345 A 2/1982 Schifj
5,168,678 A * 12/1992 Scott, Jr. ..... A01G 1/08 47/33
5,833,386 A 11/1998 Rosen et al.
7,090,430 B1 8/2006 Fletcher et al.
7,364,383 B2 4/2008 Fletcher et al.
8,534,003 B2 9/2013 Curry, III
2004/0010983 A1* 1/2004 Eshpar ..... E06B 9/15 52/71
2007/0062147 A1 3/2007 Wright
2014/0161525 A1* 6/2014 Smith ..... E01C 5/18 404/41
2015/0056013 A1* 2/2015 Brown ..... E01C 5/005 404/35
2016/0115653 A1* 4/2016 Forbes ..... E01C 5/14 404/35

* cited by examiner

*Primary Examiner* — Jessica Laux
(74) *Attorney, Agent, or Firm* — Altman & Martin; Steven K Martin

(57) ABSTRACT

A portable floor composed of a plurality of rectangular sections attached by hinges so that adjacent sections pivot between a rolled configuration for transportation and storage and a flat configuration to bear weight. A finger edge of the section has a plurality of spaced fingers with a beveled surface that extends from the bottom of the finger upwardly to the tip of the finger. The opposed notch edge of the section has a plurality of spaced notches with a beveled surface from the top of the section downwardly into the notch. The beveled surfaces are at an angle of 15° to 75°. The finger edge meshes with the notch edge of the adjacent section. Adjacent top surfaces are planar when the notch and finger beveled surfaces abut each other. The hinge is a pin extending through aligned holes in the fingers and cogs between the notches.

15 Claims, 8 Drawing Sheets

PORTABLE FLOOR

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to building construction, more particularly, to portable, temporary flooring for working in areas where only joists are installed.

2. Description of the Related Art

Many homes and building have attics and other spaces that without permanent flooring. The floor area is composed of parallel joists with exposed drywall or blueboard. There may be insulation in between. This arrangement makes it very difficult for walking around in the attic area when using it for storage or for other work on the building.

Often the building owner will lay sheets of plywood or other flat material over the top of the joists to create a passable floor surface. However, this in usually inconvenient because access to an attic is often through relatively small openings, thereby making it difficult to move plywood to the attic. Also, these sheets of plywood are not very sturdy and will not support a large amount of weight or movement.

What is desired is a portable, folding flooring unit that is capable of being easily carried into small areas, such as attics, and is sturdy enough to support a significant amount of weight regardless of its orientation relative to the joists.

BRIEF SUMMARY OF THE INVENTION

The portable floor of the present invention rolls up for transportation and storage and to flatten out to bear weight. It is composed of a plurality of rectangular sections that are attached to each other by hinges. The hinge permits adjacent sections to pivot between a flat operational configuration and a rolled storage configuration.

The finger edge of the section has a plurality of spaced fingers alternating with gaps. The notch edge of the section has a plurality of spaced notches alternating with cogs. The finger edge of one section meshes with the notch edge of the adjacent section.

Each finger has a beveled surface that extends inwardly from the tip of the finger to the bottom surface at an angle in the range of from 15° to 75° and preferably approximately 45°. Each notch has a corresponding beveled surface from the top surface of the section outwardly into the notch to the bottom surface. The top surfaces of adjacent sections are substantially planar when the notch beveled surface abuts the finger beveled surface in the operational configuration.

Adjacent sections are attached by a hinge. Each finger and each cog has a transverse hole that are aligned. A hinge pin extends through the aligned holes to form the hinge. Any method known to retain the hinge pin can be used.

The various parameters of the section are determined based on the design load and resulting moment created at the hinge, the materials used for construction and the method of manufacturing used.

The rolled portable floor of the present invention is transported to where it is needed and then rolled out flat and then flipped over.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
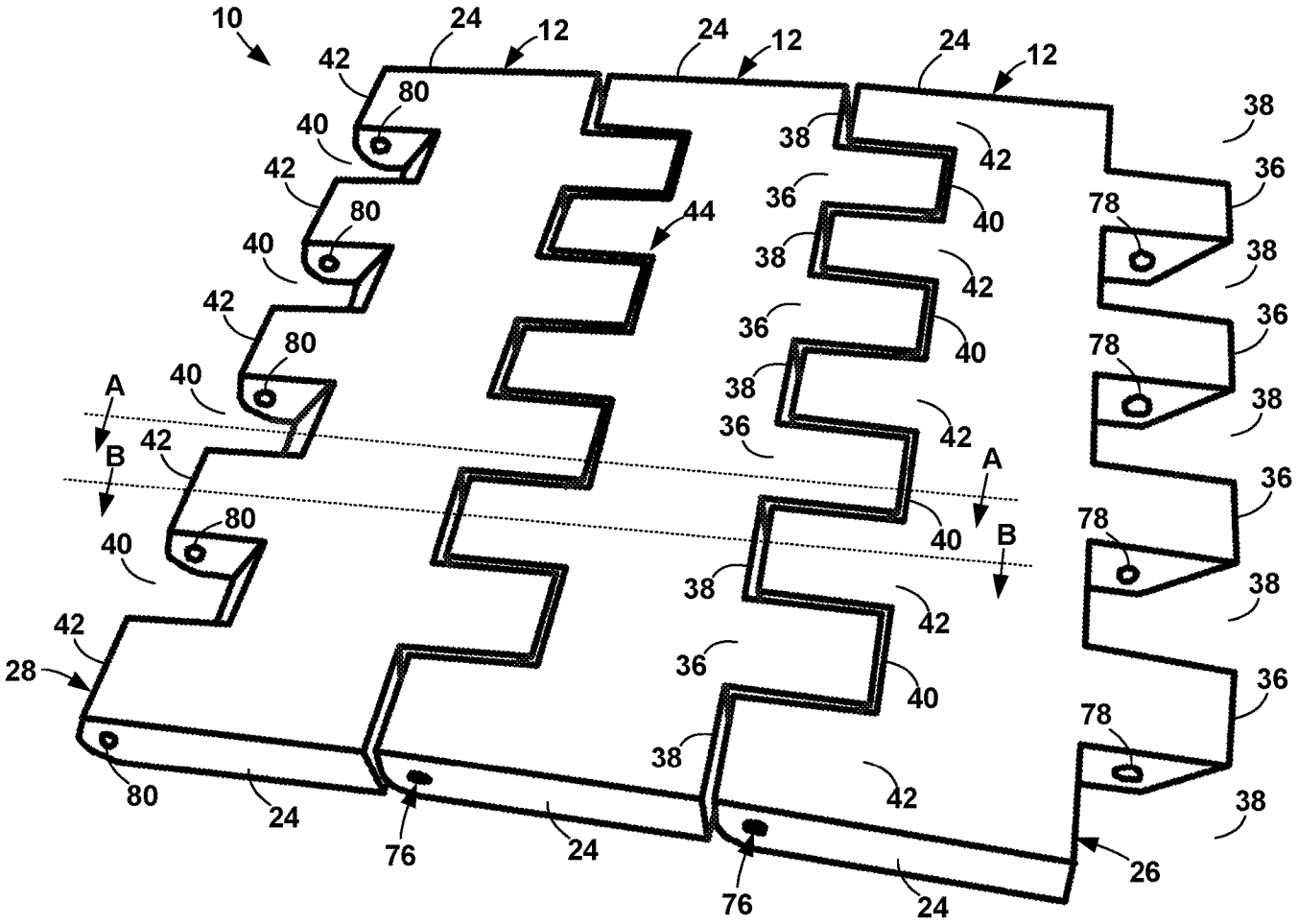
FIG. 1 is a perspective view of the portable floor of the present invention with three sections installed.
Figure 2:
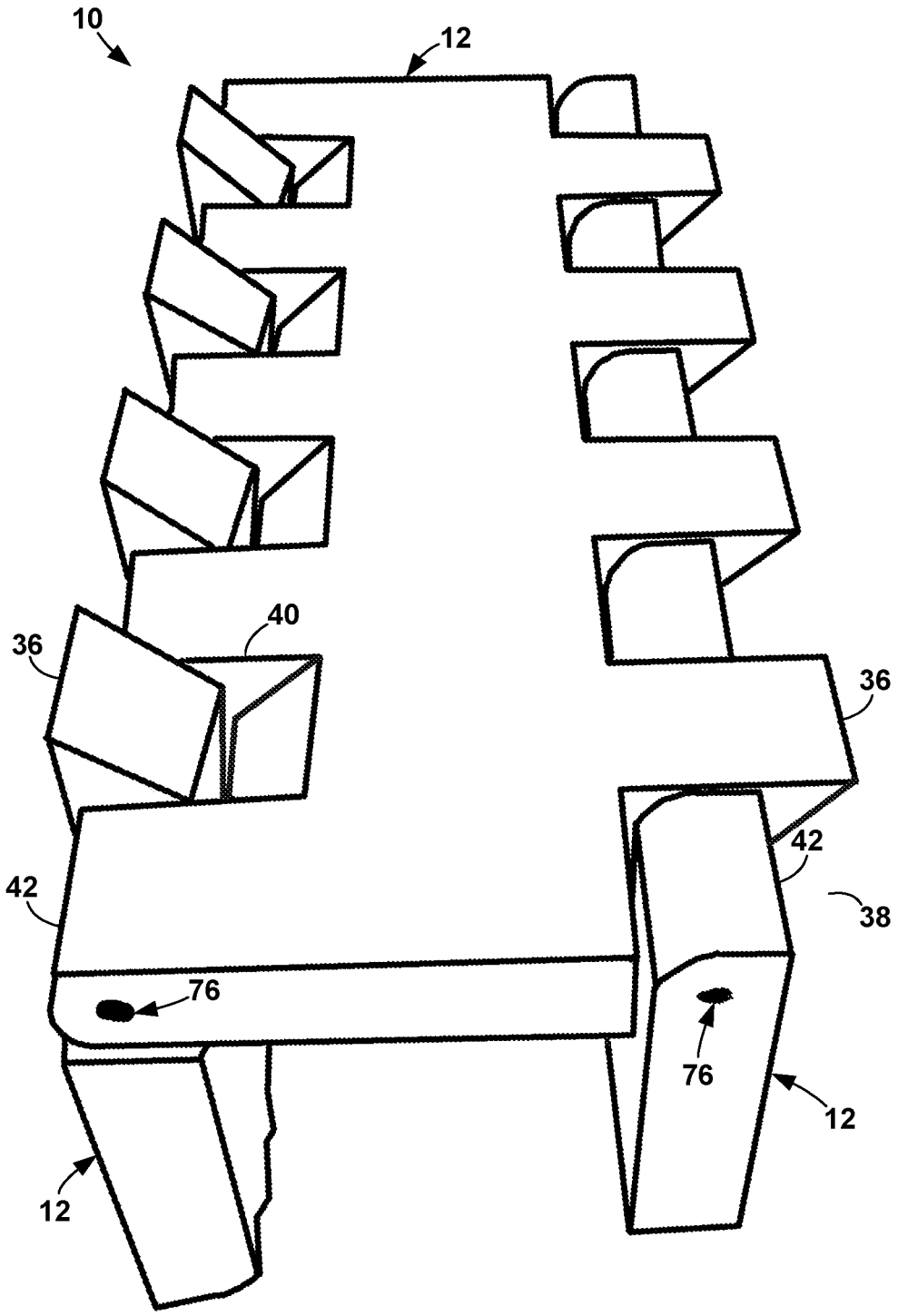
FIG. 2 is a perspective view of the portable floor of the present invention with three sections rolled.

The portable floor 10 of the present invention is designed to roll up for transportation and to flatten out to bear weight. The portable floor 10, shown in the figures, is composed of a plurality of rectangular sections 12 that are attached to each other by hinges 76. Each section 12 has a top surface 20, a bottom surface 22, opposed, parallel side edges 24, a finger edge 26, and a notch edge 28 opposed to the finger edge 26. The hinge 76 permits adjacent sections 12 to pivot between an operational configuration, shown in FIG. 1, where the top surfaces 20 are substantial co-planar, and a storage configuration, shown in FIG. 2, where the top surfaces 20 are not generally co-planar to each other.

Figure 3:
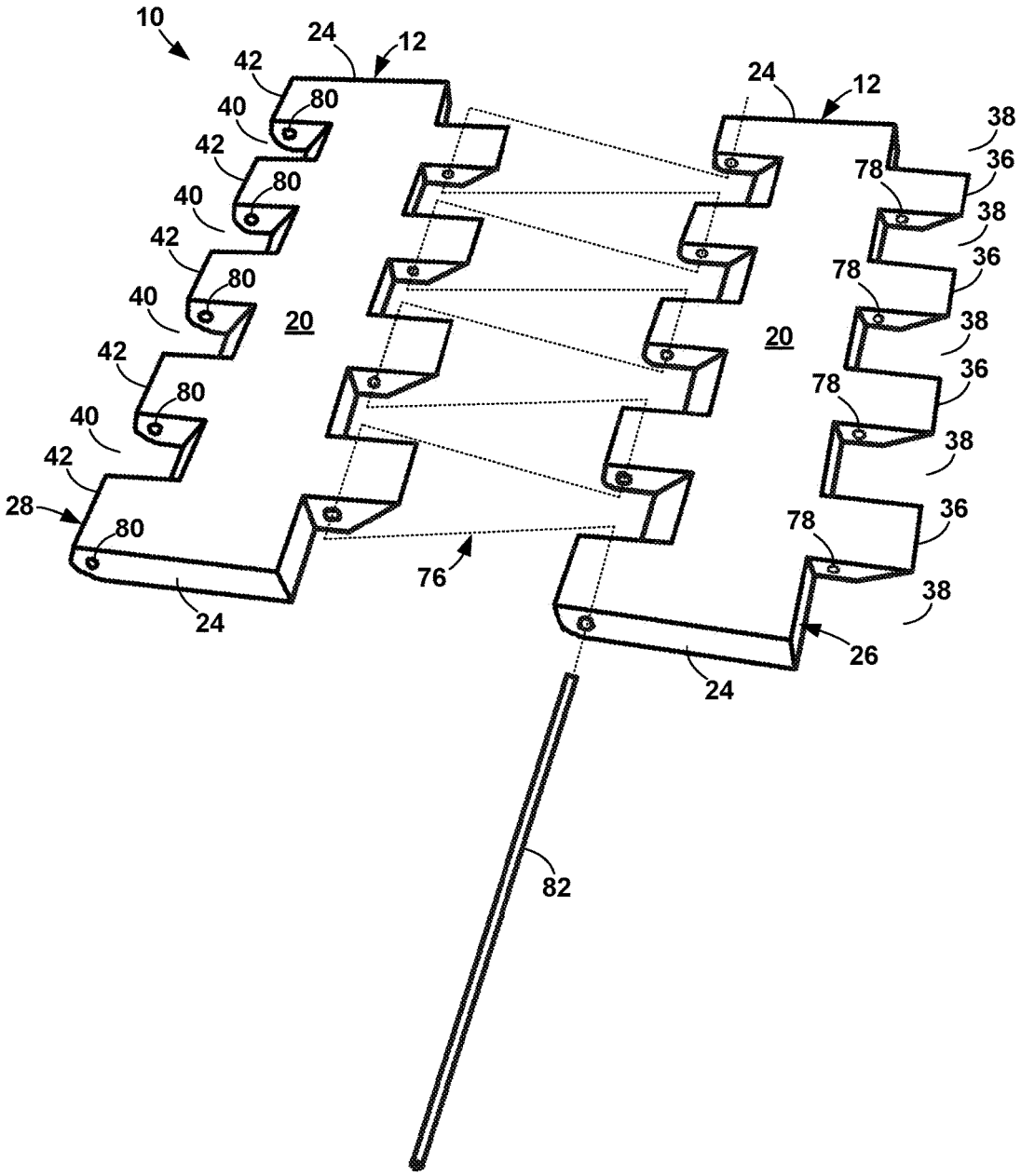
FIG. 3 is an exploded, perspective view of two sections.

As shown in FIG. 3, the finger edge 26 has a plurality of spaced fingers 36 alternating with gaps 38. The notch edge 28 has a plurality of spaced notches 40 alternating with cogs 42. Preferably, the fingers 36 and notches 40 are evenly spaced. The finger edge 26 of one section 12 meshes with the notch edge 28 of the adjacent section 12, as at 44, such that the fingers 36 fit into the notches 40 and the cogs 42 fit into the gaps 38.

Figure 4:
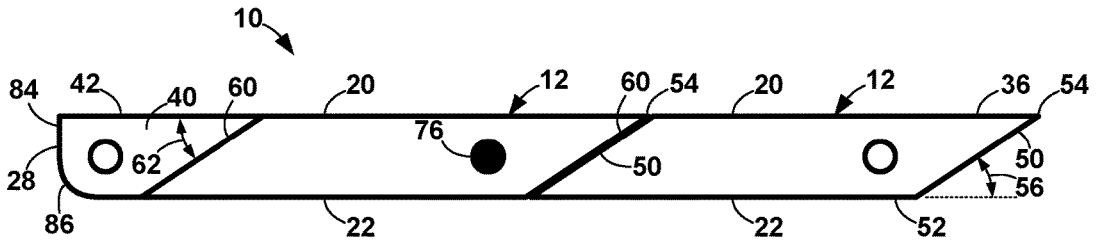
FIG. 4 is a cross-sectional view of two sections taken at A-A.

As shown in FIG. 4, each finger 36 has a beveled surface 50 that extends inwardly from the tip 54 of the finger 36 to the bottom surface 52 at an angle 56 in the range of from 15° to 75°, preferably in the range of from 30° to 60°, and most preferably approximately 45°. The angle 56 can vary depending on the size and strength of the finger 36 in combination with the maximum load that the portable floor 10 is designed to carry.

As shown in FIG. 4, each notch 40 has a beveled surface 60 that extends outwardly from the top surface 20 of the section 12 into the notch 40 to the bottom surface 52 at an angle 62 in the range of from 15° to 75°, preferably in the range of from 30° to 60°, and most preferably approximately 45°. The angle 62 can vary for the reasons described above for the finger bevel angle 56.

The notch bevel angle 62 is the same as the finger bevel angle 56 so that the top surfaces 20 of adjacent sections 12 are substantially planar when the notch beveled surface 60 abuts the finger beveled surface 50 in the operational configuration, as in FIG. 4.

Figure 6:
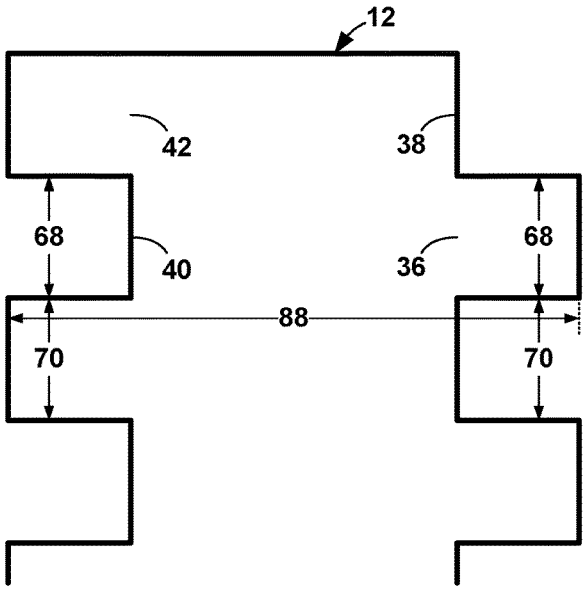
FIG. 6 is a top view of part of a section showing various parameters related to the fingers and notches.
Figure 7:
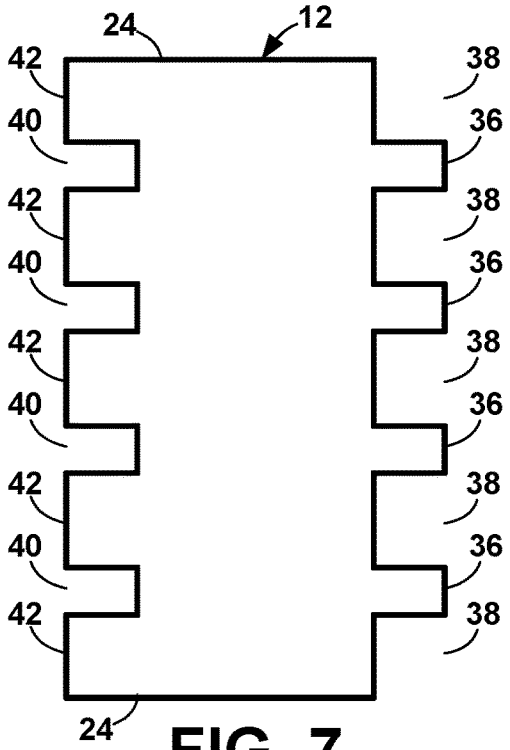
FIG. 7 is a top view of two sections showing different parameters related to the fingers and notches.
Figure 8:
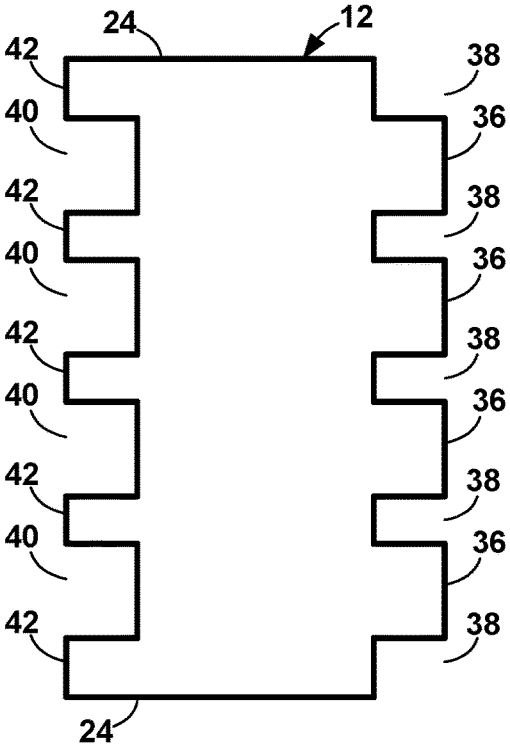
FIG. 8 is a top view of two sections showing different parameters related to the fingers and notches.

In the illustrated configuration, the width 68 of the finger 36 and notch 40 is the same as the width 70 of the gap 38 and cog 42, as in FIG. 6. However, the present invention contemplates that the finger/notch width 68 can be smaller that the gap/cog width 70, as in FIG. 7, or the finger/notch width 68 can be larger than the gap/cog width 70, as in FIG. 8.

As indicated above, adjacent sections 12 are attached by a hinge 76 so that each section 12 can pivot relative to the adjacent section 12. Each finger 36 has a transverse hole 78 and each cog 42 has a transverse hole 80. When the finger edge 26 and notch edge 28 of adjacent sections 12 are meshed, the finger holes 78 and the cog holes 80 align. A hinge pin 82 extends through the aligned holes 78, 80 to form the hinge 76. The hinge pin 82 must be robust enough to handle the weight for which the portable floor 10 is designed. Typically, the hinge pin 82 is a metal rod, either solid or hollow.

There are a number of ways known in the art to retain the hinge pin 82. In one, the finger holes 78 are slightly larger than the diameter of the hinge pin 82 and the cog holes 80 are the same size or slightly smaller than the hinge pin diameter. The hinge pin 82 is forced through the cog holes 80 and are retained by friction. Because the finger holes 78 are larger than the hinge pin diameter, the fingers 36 pivot on the hinge pin 82.

In another method of retaining the hinge pin 82, both the finger holes 78 and cog holes 80 are slightly larger than the hinge pin diameter. The hinge pin 82 is fit through the holes 78, 80 and the ends of the hinge pin 82 are expanded to larger than the cog holes 80 in order to retain the hinge pin 82. Expansion of the hinge pin ends can take the form of, for example, stretching the diameter of the hinge pin or attaching a larger diameter component to the end of the hinge pin 82. A larger diameter component can be, for example, a nut threaded onto the hinge pin end or a disk-shaped component welded or otherwise adhered to the hinge pin end.

The present invention contemplates that any method known to retain the hinge pin 82 that permits adjacent sections 12 to pivot relative to each other can be used.

Figure 5:
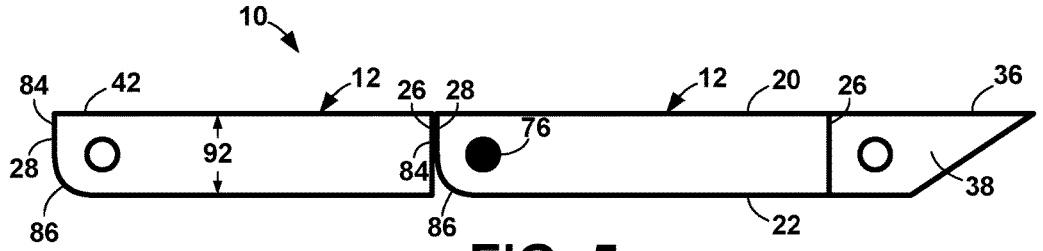
FIG. 5 is a cross-sectional view of two sections taken at B-B.

In order to facilitate pivoting about the hinge 76, the lower corner 86 of the end 84 of the cog 42 is rounded, as in FIG. 5. Alternatively, the cog 42 can be shorter than the finger 36 so that the end 84 does not interfere with the hinge 76.

Figure 9:
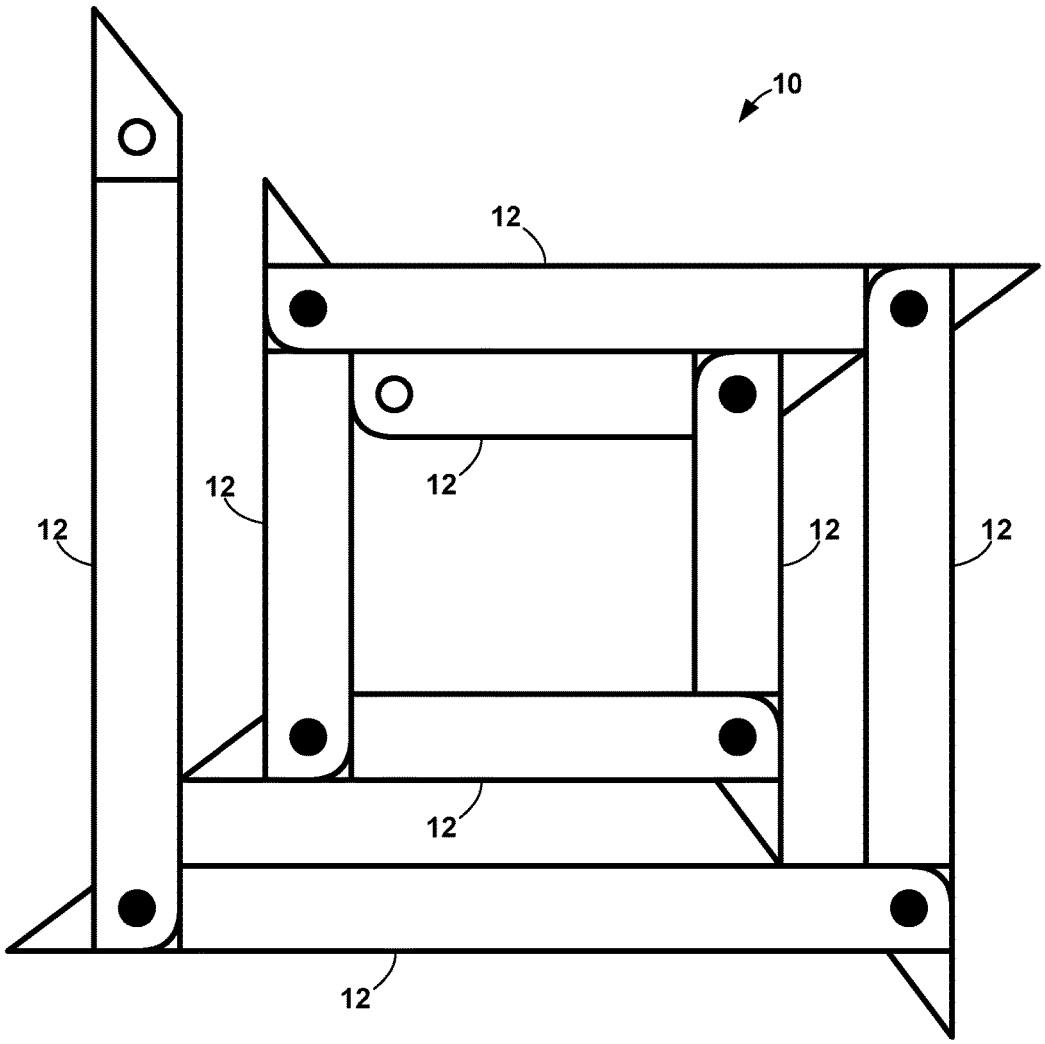
FIG. 9 is an end view of a rolled portable floor with sections having decreasing lengths.

The length 88 of the section 12 depends on the particular design, the materials from which it is composed, and ease of manipulation. The present invention contemplates that the sections 12 can all have the same length 88, as in FIG. 1, or that they can have different lengths 88. In an example of different lengths 88, the lengths increase in steps from one end of the portable floor 10 to the other end. This facilitates rolling the portable floor 10 into a more compact storage configuration, as shown in FIG. 9.

The width 90 of the section 12 depends on the particular design. The present invention does not contemplate any minimum or maximum width 90.

Figure 10:
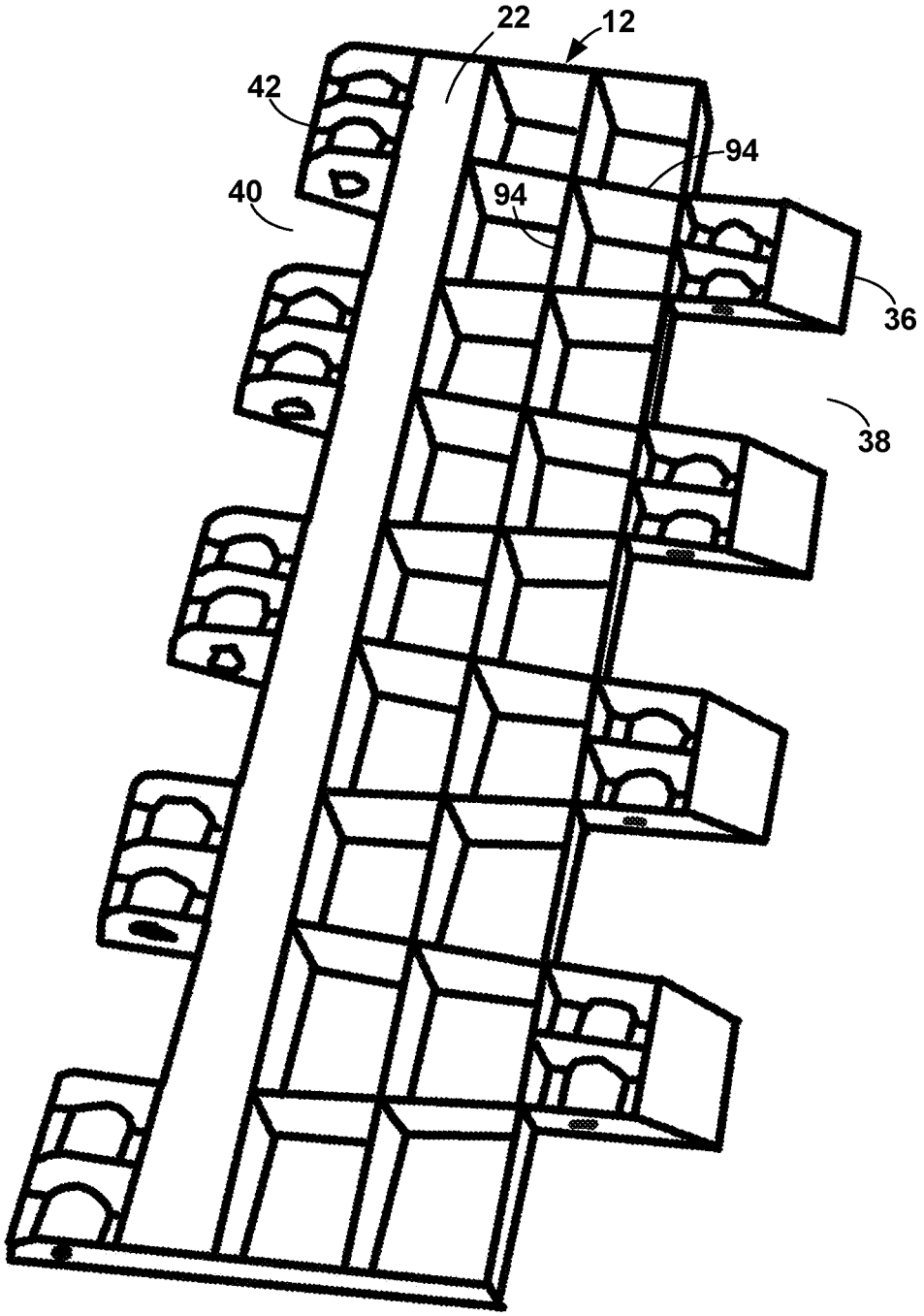
FIG. 10 is a perspective view of a configuration of the underside of a section.

The thickness 92 of the section 12 is appropriate for a combination of the material that it is composed of and the maximum weight that the portable floor 10 is designed to accommodate. In order the reduce the weight of the portable floor 10, the section 12 can be hollow and include ribs 94 for reinforcement, as in FIG. 10.

Figure 11:
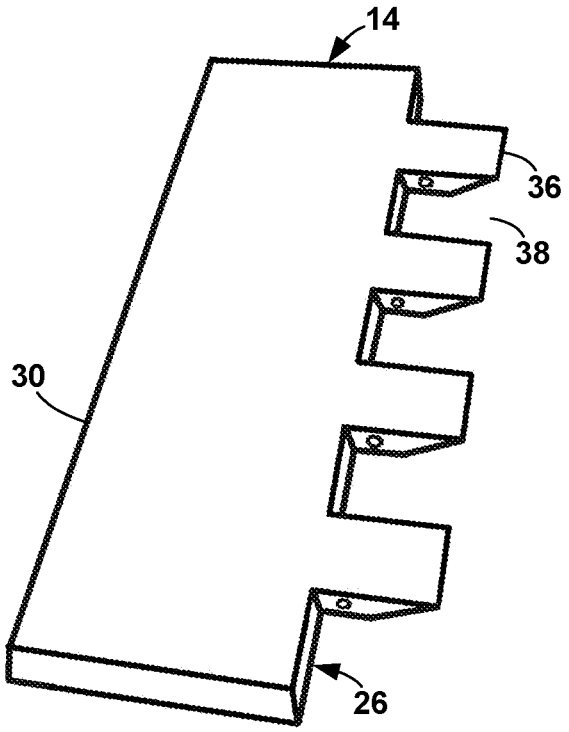
FIG. 11 is a perspective view of a finger terminal section.
Figure 12:
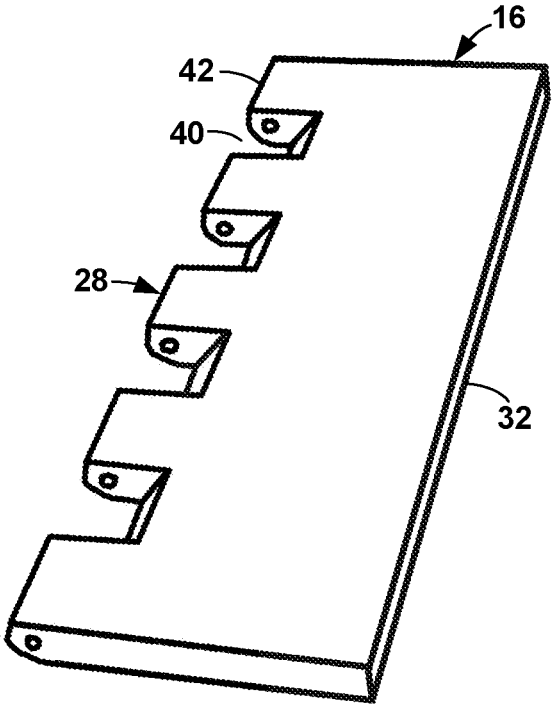
FIG. 12 is a perspective view of a notch terminal section.

The present invention contemplates that there can be terminal sections. A finger terminal section 14, shown in FIG. 11, has only a finger edge 26. The opposed edge 30 is flat with no features. A notch terminal section 12, shown in FIG. 12, has only a notch edge 28. The opposed edge 32 is flat with no features. The terminal sections 14, 16 make the portable floor 10 easier to manipulate because there are no fingers and cogs at the ends to get caught on other things.

The sections 12, 14, 16 can be composed of any rigid material that can accommodate the weight the portable floor 10 is designed for. Contemplated materials include plastics, metals, wood, and composites.

The number and parameters of the fingers 36 and notches 40 is determined by coming up with a bearing area at the given bevel angle 56, 62 that can carry the moment created by the chosen design load without exceeding the yield stress of the potential materials. Once the total area is determined, the actual material and method of manufacture are incorporated. In the present design, the section 12 is designed for injection-molded with a fairly uniform thicknesses that is removable from an injection-molding die. The result is multiple fingers 36 on multiple sections 12 that press against each other and transfer the load through the rest of the structure with a simple load path. The gaps 38 and cogs 42 are sized to have similar stress levels created by the bearing load of the hinge pin 82.

In summary, the parameters of the section 12 are determined based on the length 88, width 90, and thickness 92 of the section 12, the design load, and resulting moment created at the hinge 76, the materials used for construction and the method of manufacturing used. The goal is to minimize high stress areas while keeping the structure as light as possible for portability and cost reduction.

The portable floor 10 of the present invention is designed to be able to be taken into an unfinished area where no floor is provided, such as an attic. The rolled floor 10 is transported to where it is needed. Once the floor 10 is where needed, it can be rolled out flat and then flipped over. Because of its design, the floor of the present invention can bear weight regardless of its orientation relative to the joists.

Thus it has been shown and described a portable floor. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A portable floor comprising:

(a) a plurality of rectangular sections each having a length, a width, a top surface, a bottom surface, a finger edge, and a notch edge opposed to the finger edge;

(b) the finger edge having a plurality of spaced fingers separated by gaps, each finger having a tip and a beveled surface extending inwardly at a bevel angle from the top surface at the tip to the bottom surface;

(c) the notch edge having a plurality of spaced notches separated by cogs, each notch having a beveled surface extending outwardly at the bevel angle from the top surface into the notch to the bottom surface;

(d) a hinge attaching adjacent sections such that the finger edge of a section meshes with the notch edge of the adjacent section and such that the adjacent sections pivot between an operational configuration and a storage configuration;

(e) when in the operational configuration, the finger beveled surface abuts the notch beveled surface and the top surfaces of the adjacent sections are substantially co-planar; and (f) when in the storage configuration, the finger beveled surface do not abut the notch beveled surface and the adjacent top surfaces are not generally co-planar to each other.

2. The portable floor of claim 1 wherein the bevel angle is in the range of from 30° to 60°.

3. The portable floor of claim 2 wherein the bevel angle is approximately 45°.

4. The portable floor of claim 1 wherein the fingers and notches are evenly spaced.

5. The portable floor of claim 1 wherein the hinge is composed of a hinge pin extending through aligned holes in the fingers and cogs.

6. The portable floor of claim 1 wherein the section is hollow with reinforcing ribs.

7. The portable floor of claim 1 further comprising a finger terminal section having a finger edge and a flat edge, and a notch terminal section having a notch edge and a flat edge.

8. The portable floor of claim 1 wherein all of the plurality of sections have the same length.

9. The portable floor of claim 1 wherein all of the plurality of sections do not have the same length.

10. A portable floor comprising:

(a) a plurality of hollow, rectangular sections each having a length, a width, a top surface, a bottom surface, a finger edge, a notch edge opposed to the finger edge, and reinforcing ribs;

(b) the finger edge having a plurality of spaced fingers separated by gaps, each finger having a tip and a beveled surface extending inwardly at a bevel angle from the top surface at the tip to the bottom surface;

(c) the notch edge having a plurality of spaced notches separated by cogs, each notch having a beveled surface extending outwardly at the bevel angle from the top surface into the notch to the bottom surface;

(d) the fingers and notches being evenly spaced;

(e) a hinge attaching adjacent sections such that the finger edge of a section meshes with the notch edge of the adjacent section and such that the adjacent sections pivot between an operational configuration and a storage configuration, the hinge being composed of a hinge pin extending through aligned holes in the fingers and cogs;

(f) when in the operational configuration, the finger beveled surface abuts the notch beveled surface and the top surfaces of the adjacent sections are substantially co-planar; and (g) when in the storage configuration, the finger beveled surface do not abut the notch beveled surface and the adjacent top surfaces are not generally perpendicular co-planar to each other.

11. The portable floor of claim 10 wherein the bevel angle is in the range of from 30° to 60°.

12. The portable floor of claim 11 wherein the bevel angle is approximately 45°.

13. The portable floor of claim 10 further comprising a finger terminal section having a finger edge and a flat edge, and a notch terminal section having a notch edge and a flat edge.

14. The portable floor of claim 10 wherein all of the plurality of sections have the same length.

15. The portable floor of claim 10 wherein all of the plurality of sections do not have the same length.

* * * * *